United States Patent [19]

Olsen

[11] 4,011,992

[45] Mar. 15, 1977

[54] SYSTEM FOR HEAT CONDITIONING OF NON-STICK LIQUID PREPARATION FOR SPRAYING ON GRILL

[75] Inventor: Russell D. Olsen, Culver City, Calif.

[73] Assignee: Par-Way Mfg. Co., Los Angeles, Calif.

[22] Filed: July 23, 1975

[21] Appl. No.: 598,344

[52] U.S. Cl. ..... 239/135; 126/215; 222/146 H; 248/146; 239/273

[51] Int. Cl.[2] ..... B05B 1/24; B67D 5/62

[58] Field of Search ..... 248/146; 126/215; 239/124, 135, 273, 289, 333; 222/146 R, 146 H, 146 HA, 146 HE; 219/433

[56] References Cited

UNITED STATES PATENTS

| | | | |
|---|---|---|---|
| 279,238 | 6/1883 | Geiger | 248/146 X |
| 989,399 | 4/1911 | Norton | 126/215 |
| 1,497,643 | 6/1924 | Rutkowski | 126/215 UX |
| 2,760,481 | 8/1956 | Sprung | 126/215 |
| 2,795,461 | 6/1957 | Durkin | 222/146 HE X |
| 3,701,478 | 10/1972 | Tada | 239/333 |
| 3,904,086 | 9/1975 | Losenno | 222/146 HE |

*Primary Examiner*—Robert W. Saifer
*Assistant Examiner*—Andres Kashnikow
*Attorney, Agent, or Firm*—Forrest J. Lilly

[57] ABSTRACT

The invention comprises a device for spraying a viscous non-stick, liquid cooking preparation onto a grill heated to a predetermined temperature, and includes a stand resting on the heated grill, such that heat from the grill, by both conduction and radiation, warms the spraying device to a temperature level at which the viscosity of the preparation is reduced to a level at which it can be effectively sprayed.

6 Claims, 7 Drawing Figures

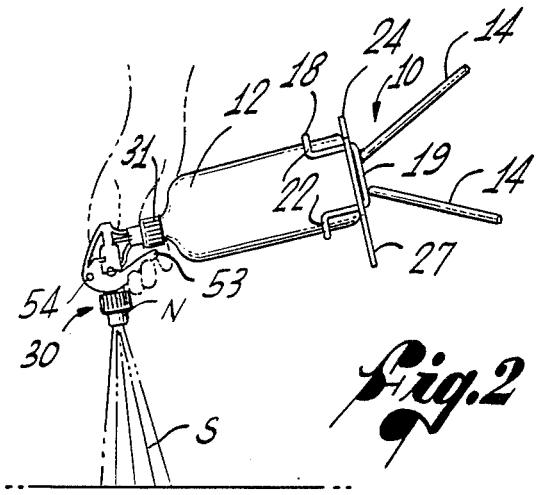
Fig.2
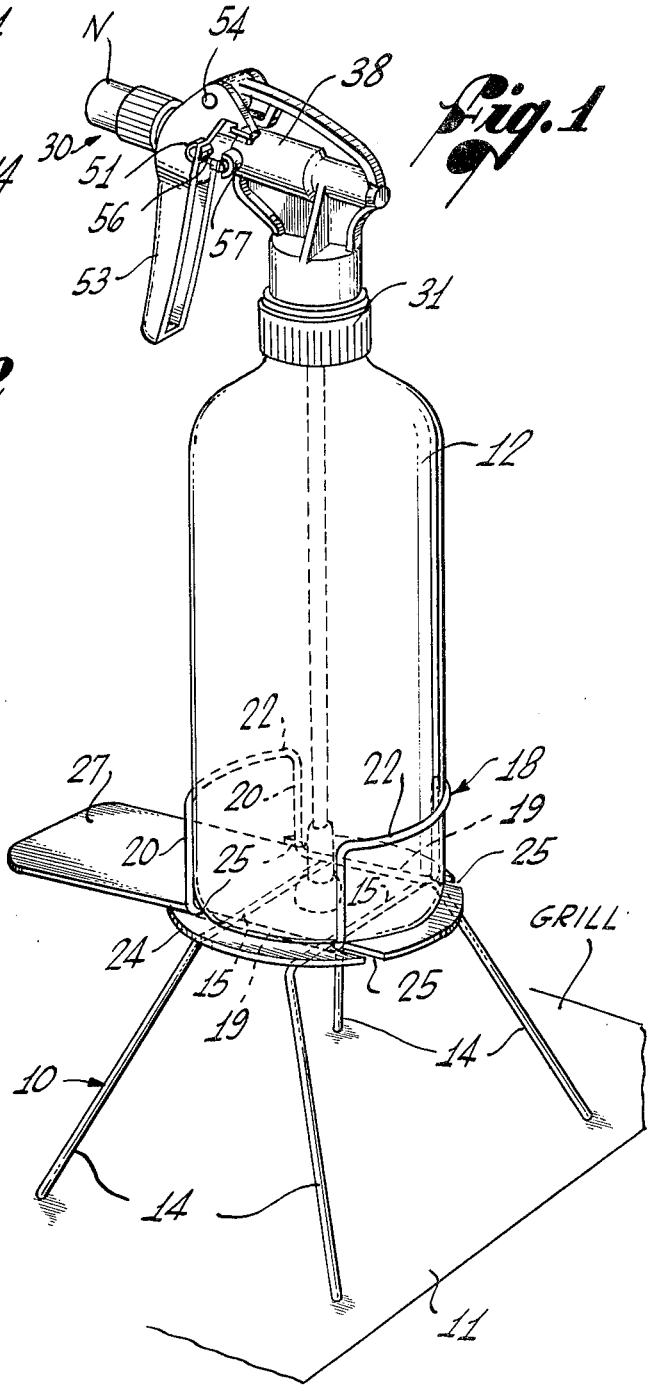
Fig.1
Fig.3
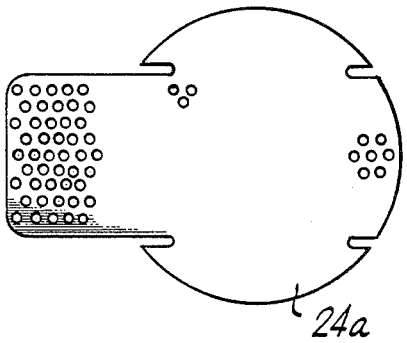

SYSTEM FOR HEAT CONDITIONING OF NON-STICK LIQUID PREPARATION FOR SPRAYING ON GRILL

FIELD OF THE INVENTION

This invention relates generally to devices for use primarily in restaurant kitchens, for spraying a non-stick pan coating substance, of an oily and somewhat viscous nature, onto a grill, or the surface of a cooking pan, to prevent sticking of the food being cooked.

BACKGROUND OF THE INVENTION

Such substances have long been used, in bakeries, and in restaurant and home kitchens. In bakeries the substance is generally sprayed on from a nozzle under pressure developed by a pump. In restaurants and in the home, the non-stick pan coating has been supplied from aerosol cans, using fluorocarbon under pressure as a suitable and effective propellant. The coating substance has been marketed under the trademarks Vegalene and Pam. Recently, the theory has been propounded that the amount of fluorocarbon being used and released throughout the world is so huge that it may endanger the protective layer of ozone surrounding the earth. Accordingly, with the substance fluorocarbon having become suspect, studies have become more intensive, banning of fluorocarbon aerosol cans has begun in some states, and there is a strong possibility that a total ban may follow eventually, if not shortly.

In this extremity, great efforts are now being made to discover a substitute practice, and the purpose of the present invention is to provide a new system and device for applying non-stick cooking oil spray, particularly adapted for restaurant use, which is capable of spraying the viscous non-stick substance properly without resort to the aerosol can charged with a fluorocarbon propellant.

BRIEF DESCRIPTION OF THE INVENTION

The present invention is premised on my discovery and application of the fact that the viscous substance to be sprayed will emerge from a fine bore nozzle on the end of a supply bottle in the form of clean, suitable, finely divided spray when heated from room temperature to a temperature of the order of 120° F., and that the temperature necessary to achieve this spray can be derived from a grill maintained at a common more or less standardized cooking temperature of substantially 385°–400° F. Having available such a grill, I place thereon a stand which supports the container for the substance to be sprayed. The container is preferably a plastic bottle, and it sits on the top of the stand. The stand preferably comprises four legs in the form of stainless steel wires adapted to stand on the heated grill. At their upper ends is a bottle support disk, for the bottom end of the bottle, and wire support rails therefor. The support disk is preferably located, by choosing the leg length of the stand, at approximately 4½ inches above the grill. Some heat rises from the heated grill to the support disk by radiation, and some travels up the legs of the stand and to the support disk by conduction. This heat then rises into the bottle and warms the viscous non-stick substance to its spray temperature, at which its viscosity is reduced to the level at which it can be properly sprayed from a suitable spray nozzle. The support disk may be a solid stainless plate, which preferably is interchangeable with one which is perforated, for reduction of heat transmission, so there is preferably provision for at least a two step adjustment of heat transmission to the bottle and contents. Thus, for example, assuming a 400° grill temperature, or thereabouts, the radiation and conduction of heat from the grill to the bottle and contents can be adjusted by this means to attain a temperature range at which the viscous non-stick substance will spray properly from the spray nozzle.

In service, the bottle and stand are thus supported on the grill, at a predetermined temperature — say 400°; and after the appropriate elevated temperature stabilization is attained, the bottle and contents are at a temperature and viscosity at which the normally viscous non-stick substance can be sprayed from the spray nozzle in a good, finely divided, and virtually dripless spray.

The bottle, with its spray device, and the stand, can then be lifted as a whole from the grill, tilted over, so that the nozzle is directed downward, and toward the surface of the grill, or the bottom of a cooking pan. Valve means are then actuated, and the spray thereupon directed onto the cooking surface to be treated. Alternatively, of course, the bottle can be lifted from the stand, and used independently thereof to coat the surface to be treated.

BRIEF DESCRIPTION OF THE DRAWINGS

FIG. 1 is a perspective view of a present preferred embodiment of the invention;

FIG. 2 is a side elevational view thereof, showing the equipment in liquid spray position;

FIG. 3 is a detail plan view of a second embodiment of bottle support disc;

DETAILED DESCRIPTION OF AN ILLUSTRATIVE EMBODIMENT

Figure 4:
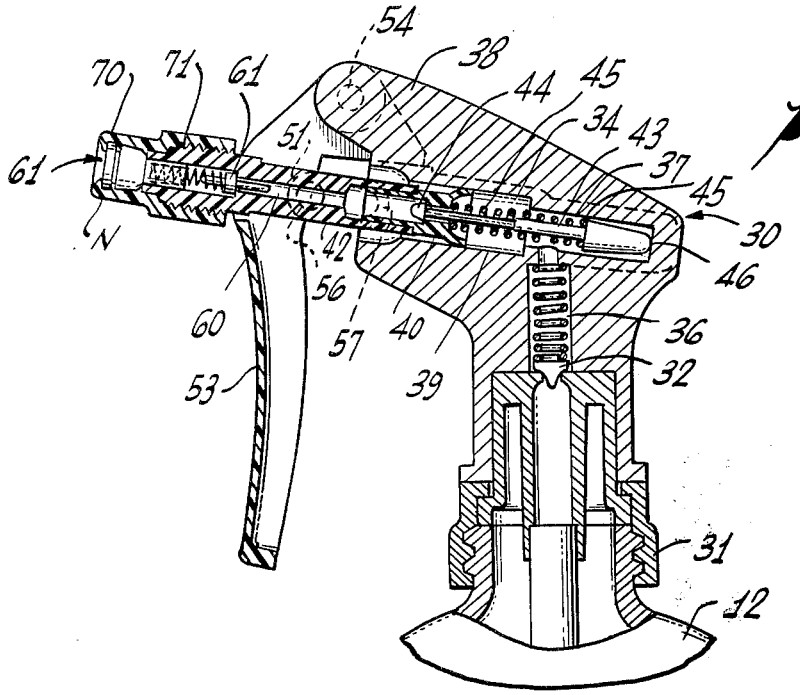
FIG. 4 is a longitudinal sectional view of the spraying device shown in the upper portion of FIG. 1.

In the drawings, numeral 10 designates the stand, 11 the grill, heated to a predetermined relatively constant cooking temperature, preferably about 400° F., and numeral 12 designates a bottle of the non-stick liquid pan coating substance to be sprayed.

As presently compounded, for use in aerosol cans, the substance includes a vegetable oil, lecithin, and a propellant. For use in the present system, the propellant is of course omitted, and spraying pressure developed by hand pumping, as presently described, at an elevated temperature, at which the substance, by reason of reduction of its viscosity, can be sprayed nicely through a suitably fashioned nozzle N, details of one satisfactory form of which will be described hereinafter.

The stand has legs 14 slightly outwardly inclined in the downward direction, and preferably four in number, comprising preferably wires composed of a heat conducting metal such as stainless steel. These legs are in two pair, as seen, the members of each pair having a horizontal connecting portion 15. The stand has also a wire vessel holder 18 comprised of two horizontal parallel segments 19, each turned vertically upward at each end to form a segment 20, and the upper ends of the two segments at each end of the two parallel and horizontal segments 19 being joined and formed to provide opposed arcuate rails 22 which oppose and preferably clamp opposite sides of the lower end of the bottle 12.

The bottle sits on a stainless steel support platform in the preferred form of a plate or disk 24. This disk is preferably larger in diameter than the circle defined by the arcuate rails 22, and it has parallel notches 25 contrived and oriented to receive the vertical wire segments 20, and so seat down on the parallel stand segments 19. Segments 19 engage and are welded to the stand segments 15, in positions across the connecting members or segments 15. The support disk 24 when assembled with the stand and holder 18 is firmly frictionally gripped by the wires of the latter, yet can be readily removed by tilting it and working it free thereof. At one end, the disk 24 has a lateral projection 27 which acts as a shield for radiant heat rising to the spray nozzle and other associated parts above during warming of the assembly.

Referring now to FIGS. 4–7, there is shown a spray device broadly disclosed in U.S. Pat. No. 3,701,478, but with certain detailed structure improved and simplified. The subject matter is not, per se, a part of my invention, but is disclosed as a previously patented device, now used in a structurally modified form as presently supplied by its manufacturer in the system of the present invention. The spray device of FIGS. 4–7 comprises generally a valved spray attachment 30 having a screw coupling 31 to the mouth of the bottle 12. A spring-pressed check valve 32 normally closes a passage 35 leading from the inside of the bottle to a passage 36, which intersects a bore 37 in body part 38. This bore is enlarged at 39, where it receives a rubber piston 40 on and fixed in a cylindrical piston 42. A stem 43 with a shutoff valve head 44 seats on a shoulder within piston 40, and is normally urged by spring 45 toward the right in FIG. 4, against a stop 46.

A lever 53 pivoted at 54 on body part 38 has half-cups 51 which engage short laterally projecting actuating pins 56 on the piston 42. Lever 53 and valve head 44 are normally in the position shown in FIG. 4 (valve head in closed position). Squeezing of handle 53 causes recession of piston 42, to the limit set by engagement of pins 56 by steps 57, opening of valve head 44, and ejection of liquid entrapped between the piston and check valve 32, so developing a pressure on said liquid which causes it to eject past the now unseated valve head 44, the passage 60, a normally closed check valve 61, and the nozzle 62. The spray is formed by the arrangements inside nozzle N, as now to be explained.

Figure 5:
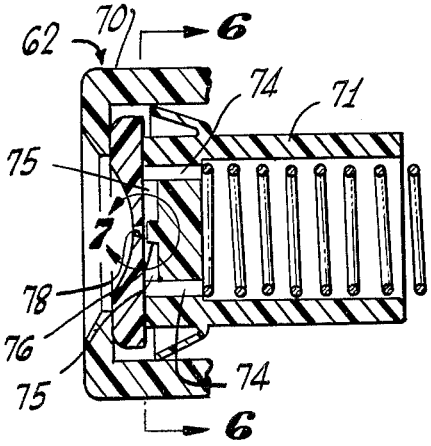
FIG. 5 is an enlarged and additionally sectioned detail of the nozzle portion of the device of FIG. 4.
Figure 6:
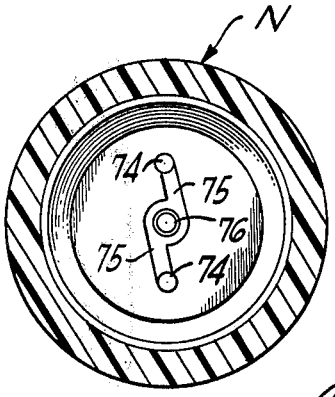
FIG. 6 is a detail section taken on line 6—6 of FIG. 5.
Figure 7:
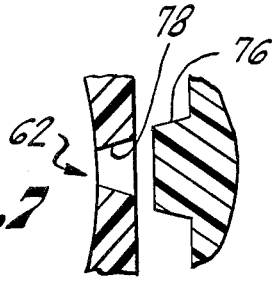
FIG. 7 is a detail to an enlarged scale of the spray orifice of FIG. 5.

The preferred nozzle assembly N is shown best in FIGS. 4 and 5. A retainer nut 70 is screwed onto the threaded head 71 on the end of the piston 42. When check valve 61 is unseated, by pumping pressure developed behind it, owing to squeezing of lever arm 53, the non-stick liquid passes this valve, then passes through two orifices 74, and enters slots or channels 75 (FIG. 3) which are tangential to a central divider cone 76. The liquid thus spins about cone 76 in the space immediately around it, and thence discharges through a small convergent orifice 78 through an orifice plate of the shape illustrated, to form a finely divided conical spray which discharges as a conical spray as suggested at S in FIG. 2. The large end of the orifice may be 0.002 inch.

Thus, to recapitulate, the stand supports the bottle at a predetermined distance above the grill which is in a predetermined standard temperature range of approximately 385°–400° F. The stand is contrived and designed to support and convey heat to the bottle to maintain the latter at a temperature of the order of substantially 120° F. for a non-stick liquid which has its viscosity lowered to permit spraying at that temperature.

It will be appreciated that coordination is required between the grill temperature, height at which the bottle is supported over the grill, the normal viscosity of the non-stick substance to be sprayed, and the orifice of the spray nozzle. One set of such coordinated design factors is given herein as a preferred example, but the factors involved are subject to some variance as will be appreciated.

What is claimed is:

1. A warming device for use with a cooking surface adapted to be maintained at a standardized cooking temperature of the order of approximately 350°–400° F., for spraying a normally viscous, liquid, vegetable and lethecin non-stick substance from a container vessel onto such cooking surface, said container vessel having a mouth at the top, and a spray attachment joined to the latter, said spray attachment having a liquid passage leading from said vessel, a generally laterally discharging spray nozzle at a discharge end of said passage, with an orifice adapted to emit a fine spray of non-viscous liquid therefrom, and valve and pumping means for developing a pressure in said passage back of said nozzle for causing said non-stick substance to discharge in a fine spray when said substance has been warmed to a temperature level below said cooking surface temperature range but sufficiently high to reduce its viscosity by an amount enabling it to spray from said nozzle, comprising:

a heat conducting stand adapted for support on said heated cooking surface, said stand comprising a pair of inverted, substantially U-shaped wire forms, each with a pair of legs and an interconnecting, horizontal top segment, in an arrangement with said top segments horizontal and spaced transversely of one another, a pair of transversely spaced wires extending across and joined integrally to said segments, said wires having at their ends vertical extensions and interconnecting generally arcuate rails furnishing support means to receive and position the lower end portion of said vessel, and a metal heat conductive platform in the form of a plate mounted on and removably secured to said transversely spaced wires, and provided with notches to pass said extensions in a clamping engagement.

2. The subject matter of claim 1 wherein the nozzle of said spray attachment extends laterally beyond said platform for a substantial distance, and said platform has a lateral projection underlying said nozzle and shielding it from heat radiated upwards from said cooking surface.

3. A device for use with a cooking surface adapted to be maintained at a standardized cooking temperature of the order of approximately 385°–400° F., for spraying a normally viscous, liquid, vegetable and lethecin non-stick substance from a container vessel onto such cooking surface, said container vessel having a mouth at the top, and a spray attachment joined to the latter, said spray attachment having a liquid passage leading from said vessel, a generally laterally discharging spray nozzle at a discharge end of said passage, with an orifice adapted to emit a fine spray of non-viscous liquid therefrom, and valve and pumping means for developing a pressure in said passage back of said nozzle for causing said non-stick substance to discharge in a fine spray when said substance has been warmed to a temperature level below said cooking surface temperature range but sufficiently high to reduce its viscosity by an amount enabling it to spray from said nozzle, comprising:

a heat conducting stand adapted for support on said heated cooking surface, said stand comprising a plurality of downwardly divergent, heat conductive metal wire legs adapted at their lower ends to engage said heated cooking surface, with substantially horizontal, bent-over segments at the upper ends thereof, heat conductive means supported by and in heat conductive relation to said bent-over segments of said leg wires, and a metal, heat conductive support plate for supporting the bottom of said vessel, said plate being supportively mounted on and in heat conductive relation to said leg segments and heat conductive means, said heat conductive means including spring wire clamp means for spring clamping the lower end of said vessel.

4. A device for use with a cooking surface adapted to be maintained at a standardized cooking temperature of the order of approximately 385°–400° F., for spraying a normally viscous, liquid, vegetable and lethecin non-stick substance from a container vessel onto such cooking surface, said container vessel having a mouth at the top, and a spray attachment joined to the latter, said spray attachment having a liquid passage leading from said vessel, a generally laterally discharging spray nozzle at a discharge end of said passage, with an orifice adapted to emit a fine spray of non-viscous liquid therefrom, and valve and pumping means for developing a pressure in said passage back of said nozzle for causing said non-stick substance to discharge in a fine spray when said substance has been warmed to a temperature level below said cooking surface temperature range but sufficiently high to reduce its viscosity by an amount enabling it to spray from said nozzle, comprising:

a heat conducting stand adapted for support on said heated cooking surface, said stand comprising a plurality of heat conductive metal wire legs adapted at their lower ends to engage said heated cooking surface, a heat conductive wire structure integral with the upper ends of said wire legs and including portions for spring clamping the lower end portion of said vessel, and a metal heat conductive support plate for supporting and heating the lower end of said vessel, said plate being supportively mounted on and in heat conductive relation to said heat conductive wire structure.

5. The subject matter of claim 4, additionally adapted for portability of the stand with the vessel by the feature that the portions of the heat conductive wire structure that spring clamp the lower end portion of the vessel are constructed to apply a tight enough clamp to hold the stand to the vessel when the vessel is raised and tilted in service.

6. The subject matter of claim 4, wherein the nozzle of said spray attachment extends laterally beyond the major portion of the perimeter of said support and heating plate for a substantial distance, and said support plate has a lateral projection underlying said nozzle and shielding it from heat radiated upwards from said cooking surface.

* * * * *